US008052172B1

(12) United States Patent
Junior

(10) Patent No.: US 8,052,172 B1
(45) Date of Patent: Nov. 8, 2011

(54) GLAD HAND LOCKING DEVICE

(76) Inventor: Kenneth D. Junior, Matteson, IL (US)

( * ) Notice: Subject to any disclaimer, the term of this patent is extended or adjusted under 35 U.S.C. 154(b) by 141 days.

(21) Appl. No.: 12/696,944

(22) Filed: Jan. 29, 2010

(51) Int. Cl.
*B61G 5/08* (2006.01)

(52) U.S. Cl. ..... 285/69; 285/88; 292/195

(58) Field of Classification Search ..... 285/69, 285/68, 82, 88, 87; 292/194, 195, 219, 220
See application file for complete search history.

(56) References Cited

U.S. PATENT DOCUMENTS 496,468 A * 5/1893 Winkenwerder ..... 285/68
RE12,902 E * 12/1908 Kilpatrick ..... 285/69
1,249,074 A * 12/1917 Haldeman ..... 285/69
3,052,489 A * 9/1962 Stoudt ..... 285/69
3,880,477 A 4/1975 Stevenson et al.
4,125,279 A * 11/1978 Scott ..... 285/69
4,129,323 A * 12/1978 Wilson ..... 285/69
4,226,103 A 10/1980 Strickland
4,747,623 A * 5/1988 Newcomb et al. ..... 285/69
4,787,770 A * 11/1988 Lewis ..... 285/82
5,129,243 A 7/1992 Kassebaum
D334,879 S 4/1993 Few
5,251,666 A * 10/1993 Kimball et al. ..... 285/69
5,388,864 A * 2/1995 Kozinski ..... 285/69
5,410,894 A 5/1995 Fox et al.
5,685,573 A * 11/1997 Nadherny et al. ..... 285/69
5,911,444 A * 6/1999 Buchter et al. ..... 285/69
5,971,442 A * 10/1999 Kozinski et al. ..... 285/69
6,669,237 B1 * 12/2003 Burch et al. ..... 285/69
7,461,869 B2 * 12/2008 Sommerfeld ..... 285/69

* cited by examiner

*Primary Examiner* — David E Bochna

(57) ABSTRACT

A glad hand locking device featuring a mounting bracket mountable atop the glad hand mating plate of a base glad hand via bolts; a pivot arm pivotally attached to the mounting bracket, the pivot arm can pivot between an up position and a down position wherein the second end of the pivot arm is pushed downwardly past the mounting bracket, the pivot arm is biased in the up position caused by a tension spring extending from the first end of the pivot arm to the first end of the mounting bracket; and a latch disposed on the second end of the pivot arm, wherein when the mating glad hand is mated atop the base glad hand, the pivot arm can be pushed to the down position such that the latch can snugly engage the tab of the mating glad hand.

6 Claims, 4 Drawing Sheets

GLAD HAND LOCKING DEVICE

FIELD OF THE INVENTION

The present invention is directed to an accessory for glad hands, more particularly to a device for locking glad hands to prevent them from becoming loose or disconnected. The glad hand locking device can be used on either a tractor glad hand or a trailer glad hand.

BACKGROUND OF THE INVENTION

Air hoses from the break systems of trailers and the air hoses from the break systems of tractors are generally coupled via glad hands, which provide air pressure and an electrical cable providing power to the lights and any specialized features of the trailer. Generally, one glad hand component (a base glad hand) is rigidly attached to the trailer and a corresponding glad hand component (a mating glad hand) is connected to an air hose extending from the brake system of the tractor. When the two glad hand components are mated, a leak-free path exists between the braking system of the tractor and the braking system of the trailer so that high pressure is maintained.

Once the glad hands are mated, the glad hands are only held in place by the glad hand shield (standard glad hand mating plate). The glad hand shield (standard glad hand mating plate) can be easily moved by a gentle push upward by the driver, thus disconnecting the glad hands. Or, in some cases, the glad hands can become disconnected by rotation of the glad hands, movements when driving down the road, wear on the glad hand shield of either the truck or trailer, bumps and dips in the road, u-turns, sharp turns, etc. The present invention features a glad hand locking device. The glad hand locking device helps prevent glad hands from becoming loose or disconnected from each other. The glad hands can only be released by pressing on a spring lock.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a glad hand locking device for a base glad hand and a mating glad hand, wherein the glad hands each comprise a main housing having a tab disposed on a first end, a support plate disposed on a second end opposite the tab, and a removable standard glad hand mating plate mounted atop the support plate.

The glad hand locking device of the present invention comprises an elongated mounting bracket for mounting atop the standard glad hand mating plate of the base glad hand, wherein the mounting bracket has a first aperture disposed in a first end and a second aperture disposed in a second end, the first aperture and the second aperture being positioned to align with two apertures of the standard glad hand mating plate, the first aperture and the second aperture are adapted to receive bolts for securing the mounting bracket to the standard glad hand mating plate.

The glad hand locking device further comprises a wing component disposed on a fourth edge of the mounting bracket, the wing component extends upwardly and generally perpendicularly from mounting bracket a pivot arm having a first end and a second end, the pivot arm is pivotally attached to the wing component via a pivot bolt, the pivot arm can pivot with respect to the pivot bolt between an up position wherein the second end of the pivot arm is pushed upwardly away from the mounting bracket and a down position wherein the second end of the pivot arm is pushed downwardly past the mounting bracket, the pivot arm is biased in the up position caused by a tension spring extending from the first end of the pivot arm to the first end of the mounting bracket; and a latch disposed on the second end of the pivot arm, wherein when the mating glad hand is mated atop the base glad hand, the pivot arm can be pushed to the down position such that the latch can snugly engage the tab of the mating glad hand.

In some embodiments, the mounting bracket comprises a raised middle portion. In some embodiments, the wing component comprises a wing aperture for accommodating the pivot bolt. In some embodiments, the pivot arm comprises a pivot bolt aperture for accommodating the pivot bolt. In some embodiments, the pivot bolt is secured in the pivot bolt aperture and the wing aperture via a nut. In some embodiments, the first end of the tension spring surrounds a first tooth extending from the first end of the pivot arm and the second end of the tension spring is positioned around a second tooth extending upwardly from the first end of the mounting bracket.

BRIEF DESCRIPTION OF THE DRAWINGS

FIG. 2 shows how the glad hand locking device of the present invention can be mounted on a standard glad hand mating plate.

DESCRIPTION OF PREFERRED EMBODIMENTS

Figure 1:
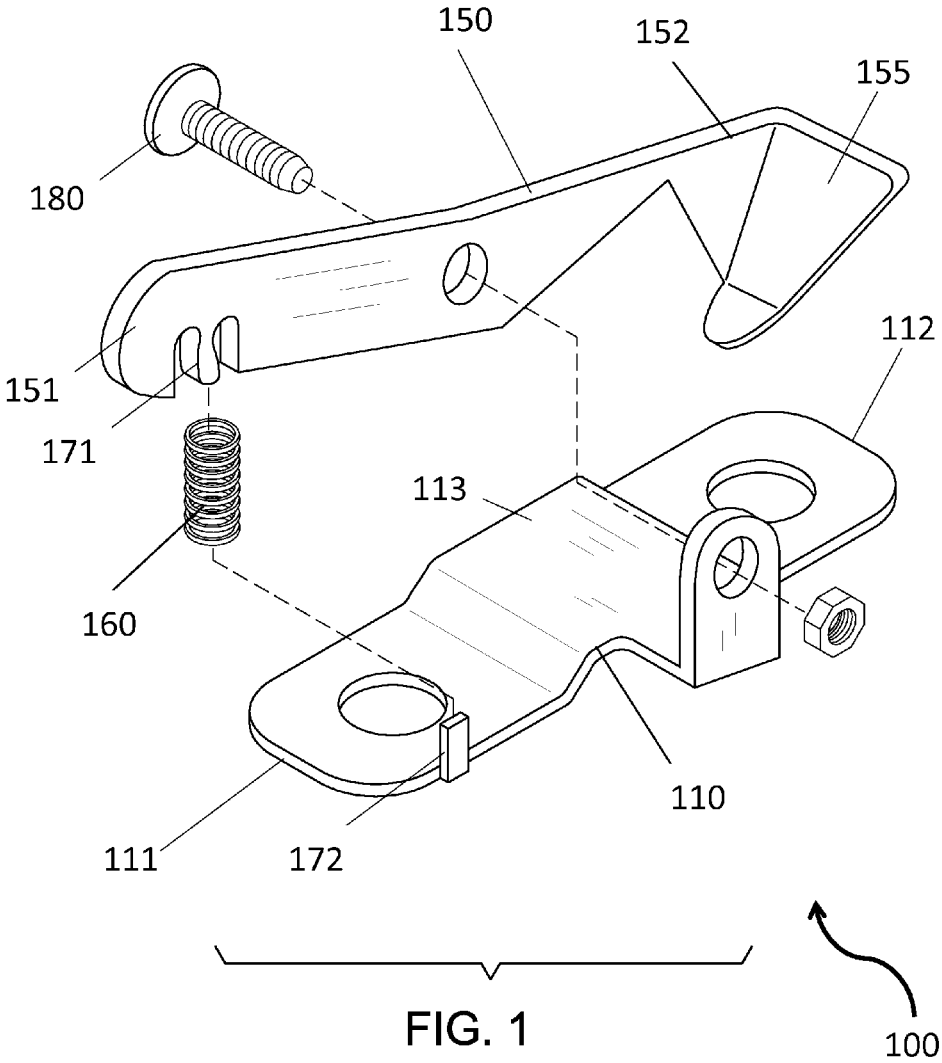
FIG. 1 is a first exploded view of the glad hand locking device of the present invention.
Figure 2:
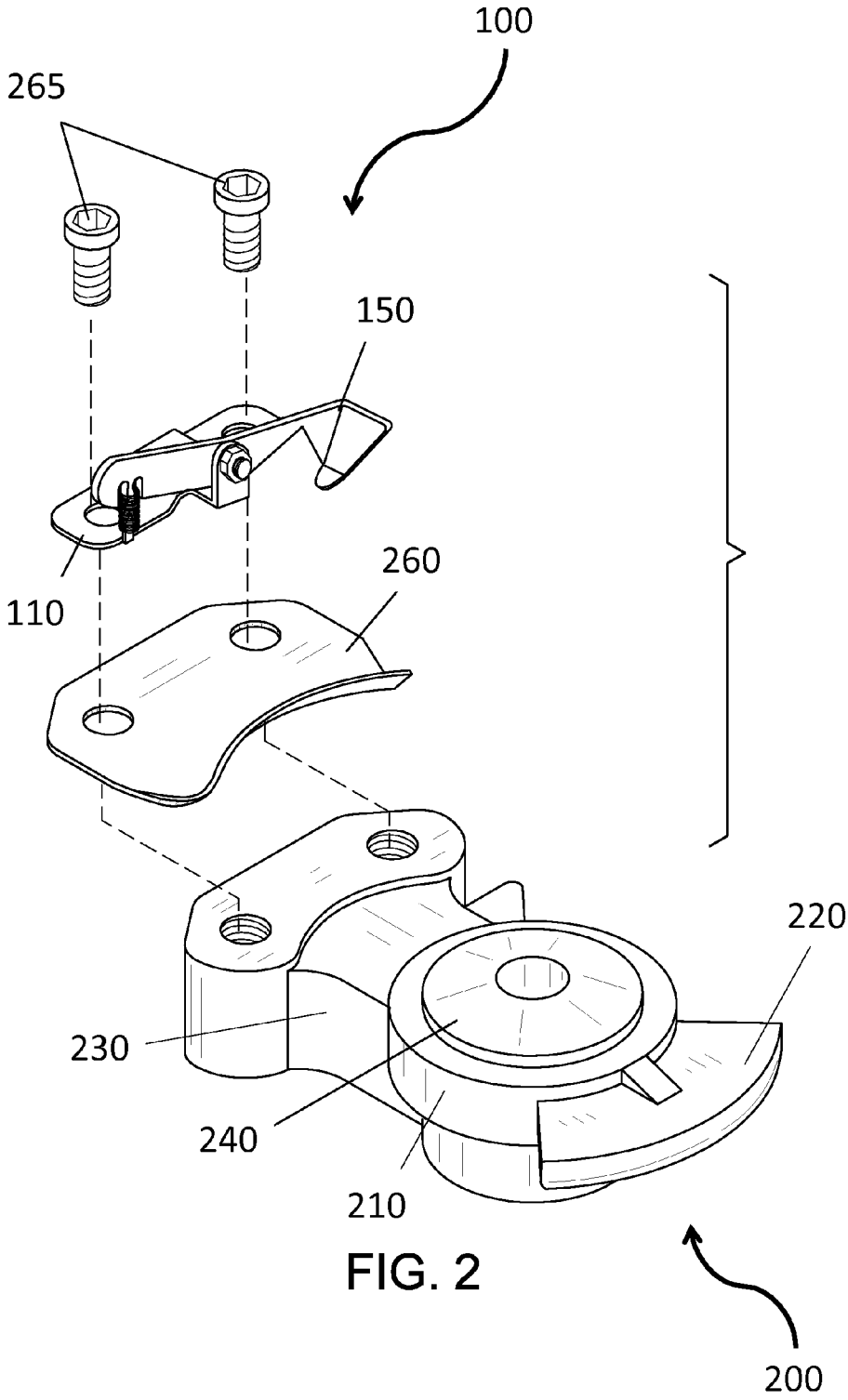
FIG. 2 is a second exploded view of the glad hand locking device.
Figure 3:
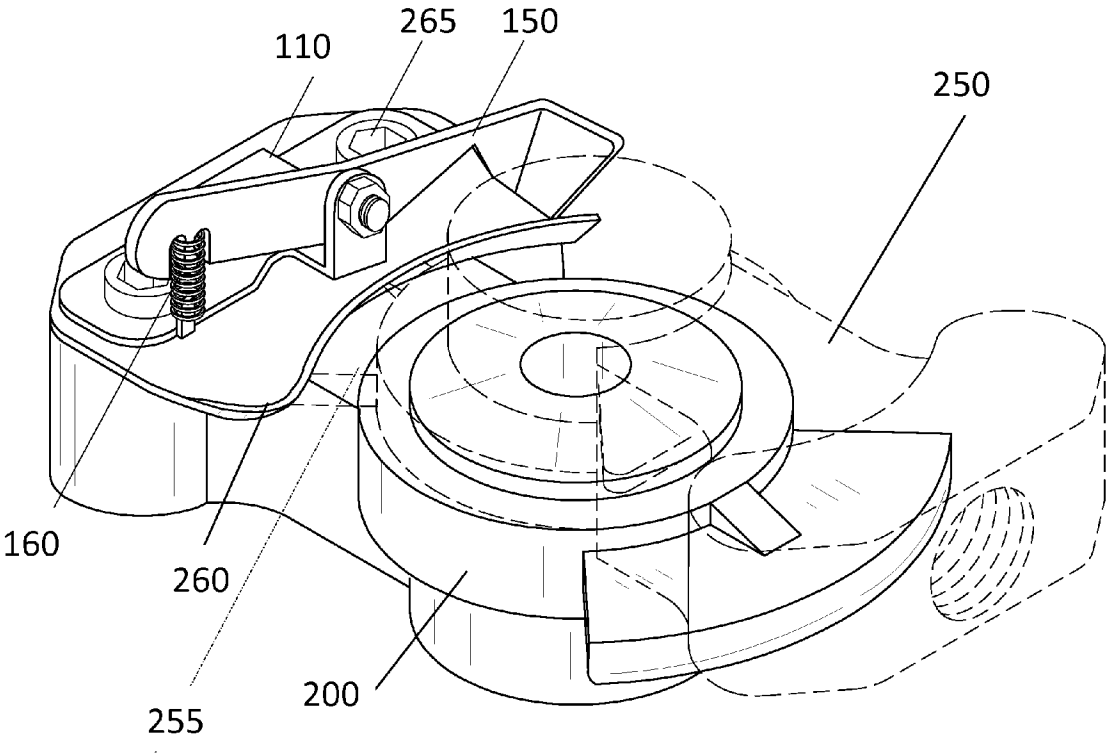
FIG. 3 is a perspective view of the glad hand locking device of the present invention mounted on a base glad hand. A mating glad hand is shown in phantom. The mating glad hand is positioned over the base glad hand.

Referring now to FIGS. 1-5, the present invention features a glad hand locking device 100 for preventing glad hands from becoming loose or disconnected from each other. The glad hand locking device can be used on either a tractor glad hand or a trailer glad hand. Glad hands are well known to one of ordinary skill in the art. The base glad hand shown in FIG. 2 comprises a main housing 210 having a tab 220 disposed on a first end and a support plate 230 disposed on a second end opposite the tab 220. The main housing has a generally circular shape (e.g., as viewed from above). Disposed on the main housing is a grommet 240, wherein an air passage opening is disposed in the grommet 240. The air passage opening connects to an air passage disposed in the support plate 230 (not shown). As shown in FIG. 3, a mating glad hand 250 (shown in phantom) is mounted atop the base glad hand 200.

FIG. 2 shows a standard glad hand mating plate 260 attachable to the top surface of the support plate 230. Standard glad hand mating plates are well known to one of ordinary skill in the art. The standard glad hand mating plate 260 comprises two apertures, which align with the two threaded holes in the top surface of the support plate 230. The standard glad hand mating plate 260 is secured to the support plate 230 via bolts 265. As shown in FIG. 3, when a mating glad hand 250 is mounted over the base glad hand 200, the tab 255 of the mating glad hand 250 is positioned under the bottom surface of the standard glad hand mating plate 260.

The glad hand locking device 100 of the present invention comprises a mounting bracket 110 adapted for mounting atop the standard glad hand mating plate 260. As shown in FIG. 1, the mounting bracket 110 is an elongated panel (generally flat) having a first end 111, a second end 112, and a raised middle portion 113. A first aperture 121 is disposed in the first end 111 of the mounting bracket 110, and a second aperture 122 is disposed in the second end 112 of the mounting bracket 110. The first aperture 121 and second aperture 122 are positioned to align with the threaded holes in the top surface of the support plate 230 and the apertures in the standard glad hand mating plate 260. This allows the mounting bracket 110 to be secured to the support plate 230 along with the standard glad hand mating plate 260 via the bolts 265.

The mounting bracket 110 has a first edge at the first end 111, a second edge at the second end 112, a third edge, and a fourth edge. Disposed on the fourth edge at the area of the raised middle portion 113 of the mounting bracket 110 is a wing component 130. The wing component 130 extends upwardly from the raised portion 113 of the mounting bracket 110 As shown in FIG. 1, the wing component 130 is generally perpendicular to the mounting bracket and comprises a wing aperture.

The glad hand locking device 100 of the present invention further comprises a pivot arm 150. The pivot arm 150 has a first end 151 and a second end 152. The pivot arm 150 is pivotally attached to the wing component 130 on the mounting bracket 110. As shown in FIG. 1, a pivot bolt aperture is disposed in the pivot arm 150 about halfway between the first end 151 and the second end 152. The pivot bolt aperture is adapted to receive a pivot bolt 180, which further is driven into the wing aperture of the wing component 130 of the mounting bracket 130. The pivot arm 150 can pivot about the pivot bolt 180. In some embodiments, the pivot bolt 180 is secured in the pivot bolt aperture and wing aperture via a nut.

The pivot arm 150 can move between an up position and a down position. In the up position, the second end 152 of the pivot arm 150 is pushed upwardly and the first end 151 is pushed downwardly. In the down position, the second end 152 of the pivot arm 150 is pushed downwardly and the first end 151 upwardly, The pivot arm 150 is biased in the up position (the second end 152 of the pivot arm 150 is up) caused by a tension spring 160. The tension spring 160 is disposed on the first end 151 of the pivot arm 150 and extends to the first end 111 of the mounting bracket 110.

As shown in FIG. 1, the first end of the tension spring 160 surrounds a first tooth 171 extending from the first end 151 of the pivot arm 150, The second end of the tension spring is positioned around a second tooth 172 extending upwardly from the first end 111 of the mounting bracket 1100

Disposed on the second end 152 of the pivot arm 150 is a latch 155. The latch 155 is for engaging (e.g., snugly hugging) the tab of the glad hand. As shown in FIG. 3, the latch 155 is pushed downwardly and wrapped around the tab 255 of the mating glad hand 250. The latch 155 helps prevent rotation of the glad hands.

Figure 4:
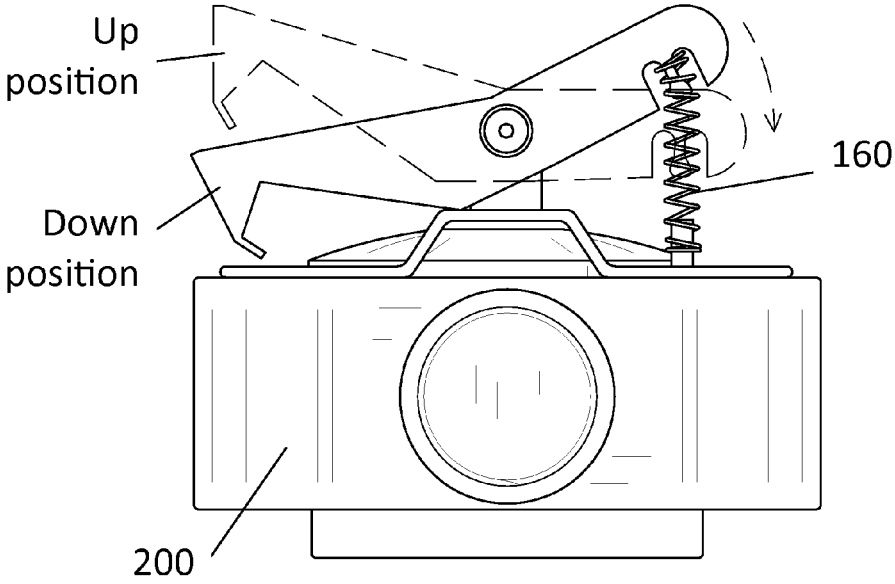
FIG. 4 is a side view and in-use view of the glad hand locking device of the present invention. The pivot arm can pivot about the pivot bolt between an up position and a down position.
Figure 5:
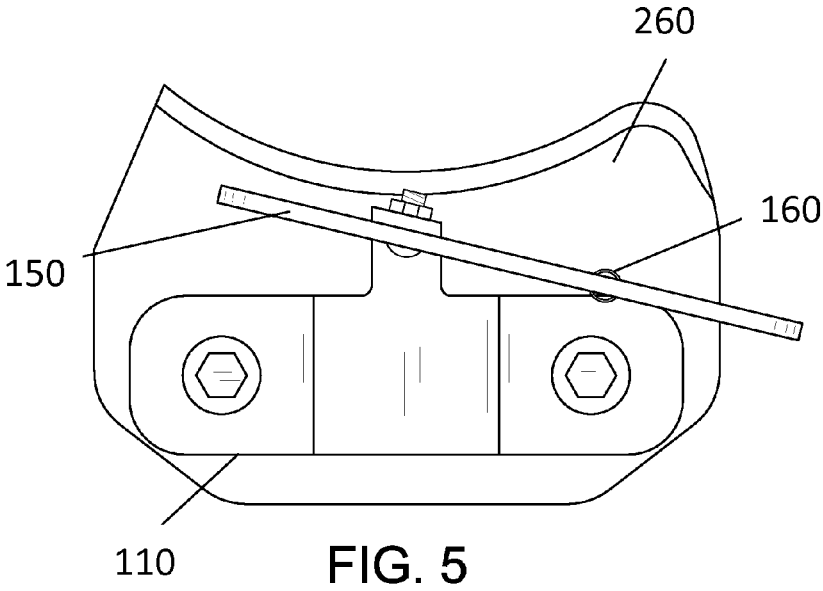
FIG. 5 is a top view of the locking device of FIG. 4.

As shown in FIG. 4, the pivot arm 150 can pivot between an up position and a down position, and the pivot arm 150 is biased in the up position caused by the tension spring 160. However, the pivot arm 150 can be pushed to the down position and then the latch secured around the tab of the glad hand. The tab keeps the pivot arm 150 secured and locked in the down position.

The following the disclosures of the following U.S. patents are incorporated in their entirety by reference herein: U.S Pat No. 5,685,573; U.S. Pat. No. 4,226,103; U.S. Pat. No. 4,325,237; U.S. Pat. No. 5,076,077.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A glad hand locking device for a base glad hand and a mating glad hand, the glad hands each comprising a main housing having a tab disposed on a first end, a support plate disposed on a second end opposite the tab, and a removable standard glad hand mating plate mounted atop the support plate, the glad hand locking device comprising:

(a) an elongated mounting bracket for mounting atop the standard glad hand mating plate of the base glad hand, wherein the mounting bracket has a first aperture disposed in a first end and a second aperture disposed in a second end, the first aperture and the second aperture being positioned to align with two apertures of the standard glad hand mating plate, the first aperture and the second aperture are adapted to receive bolts for securing the mounting bracket to the standard glad hand mating plate;

(b) a wing component disposed on a fourth edge of the mounting bracket, the wing component extends upwardly and generally perpendicularly from mounting bracket;

(c) a pivot arm having a first end and a second end, the pivot arm is pivotally attached to the wing component via a pivot bolt, the pivot arm can pivot with respect to the pivot bolt between an up position wherein the second end of the pivot arm is pushed upwardly away from the mounting bracket and a down position wherein the second end of the pivot arm is pushed downwardly past the mounting bracket, the pivot arm is biased in the up position caused by a tension spring extending from the first end of the pivot arm to the first end of the mounting bracket; and (d) a latch disposed on the second end of the pivot arm, wherein when the mating glad hand is mated atop the base glad hand, the pivot arm can be pushed to the down position such that the latch can snugly engage the tab of the mating glad hand.

2. The glad hand locking device of claim 1, wherein the mounting bracket comprises a raised middle portion.

3. The glad hand locking device of claim 1, wherein the wing component comprises a wing aperture for accommodating the pivot bolt.

4. The glad hand locking device of claim 3, wherein the pivot arm comprises a pivot bolt aperture for accommodating the pivot bolt.

5. The glad hand locking device of claim 4, wherein the pivot bolt is secured in the pivot bolt aperture and the wing aperture via a nut.

6. The glad hand locking device of claim 1, wherein a first end of the tension spring surrounds a first tooth extending from the first end of the pivot arm and a second end of the tension spring is positioned around a second tooth extending upwardly from the first end of the mounting bracket.

* * * * *